US010612544B2

(12) United States Patent
Spencer et al.

(10) Patent No.: US 10,612,544 B2
(45) Date of Patent: Apr. 7, 2020

(54) ROTARY VANE DEVICE HAVING MAGNET ARRANGED IN ROTOR AND STATOR

(71) Applicant: AZAMOUR INVESTMENT CORPORATION INCORPORATED, Ras Al Khaimah (AE)

(72) Inventors: Michael John David Spencer, Barberton (ZA); Stephen Reuben Nicholson, Nelspruit (ZA)

(73) Assignee: AZAMOUR INVESTMENT CORPORATION INCORPORATED C/O OCRA ARABIA FZC, Ras al Khaimah (AE)

( * ) Notice: Subject to any disclaimer, the term of this patent is extended or adjusted under 35 U.S.C. 154(b) by 126 days.

(21) Appl. No.: 15/562,578

(22) PCT Filed: Mar. 30, 2016

(86) PCT No.: PCT/IB2016/051790
§ 371 (c)(1),
(2) Date: Sep. 28, 2017

(87) PCT Pub. No.: WO2016/157090
PCT Pub. Date: Oct. 6, 2016

(65) Prior Publication Data

US 2018/0087506 A1 Mar. 29, 2018

(30) Foreign Application Priority Data

Mar. 31, 2015 (ZA) ..... 2015/02233

(51) Int. Cl.
*F04C 27/00* (2006.01)
*F04C 18/344* (2006.01)
(Continued)

(52) U.S. Cl.
CPC ..... *F04C 2/3441* (2013.01); *F01C 21/0818* (2013.01)

(58) Field of Classification Search
CPC .. F01C 21/0818; F04C 2/3442; F04C 27/001; F05C 2251/12
(Continued)

(56) References Cited

U.S. PATENT DOCUMENTS 4,132,512 A 1/1979 Roberts
8,915,726 B2 * 12/2014 Liang ..... F01C 1/3442 418/146

OTHER PUBLICATIONS

International Search Report for PCT/IB2016/051790 dated Jun. 21, 2016.

* cited by examiner

*Primary Examiner* — Deming Wan
(74) *Attorney, Agent, or Firm* — Thomas | Horstemeyer, LLP

(57) ABSTRACT

This invention relates to a rotary vane device and more particularly but not exclusively, to a rotary vane engine or pump. The invention also relates to a rotor assembly suitable for use in such a rotary vane device. The rotor assembly includes a cylindrical rotor body including a plurality of longitudinally extending receiving slots, the cylindrical rotor body further including a hollow core located radially inwardly of the receiving slots; and a plurality of vanes, with each vane being slidingly locatable inside a receiving slot. The rotor assembly is characterized in that the vanes are biased away from the cylindrical rotor by way of a magnet arrangement including vane magnets located in the vanes, and opposing rotor magnets located inside the hollow core of the rotor body.

9 Claims, 4 Drawing Sheets

(51) Int. Cl.
*F01C 21/08* (2006.01)
*F04C 2/344* (2006.01)

(58) Field of Classification Search
USPC ..... 418/158, 269, 266, 268, 267
See application file for complete search history.

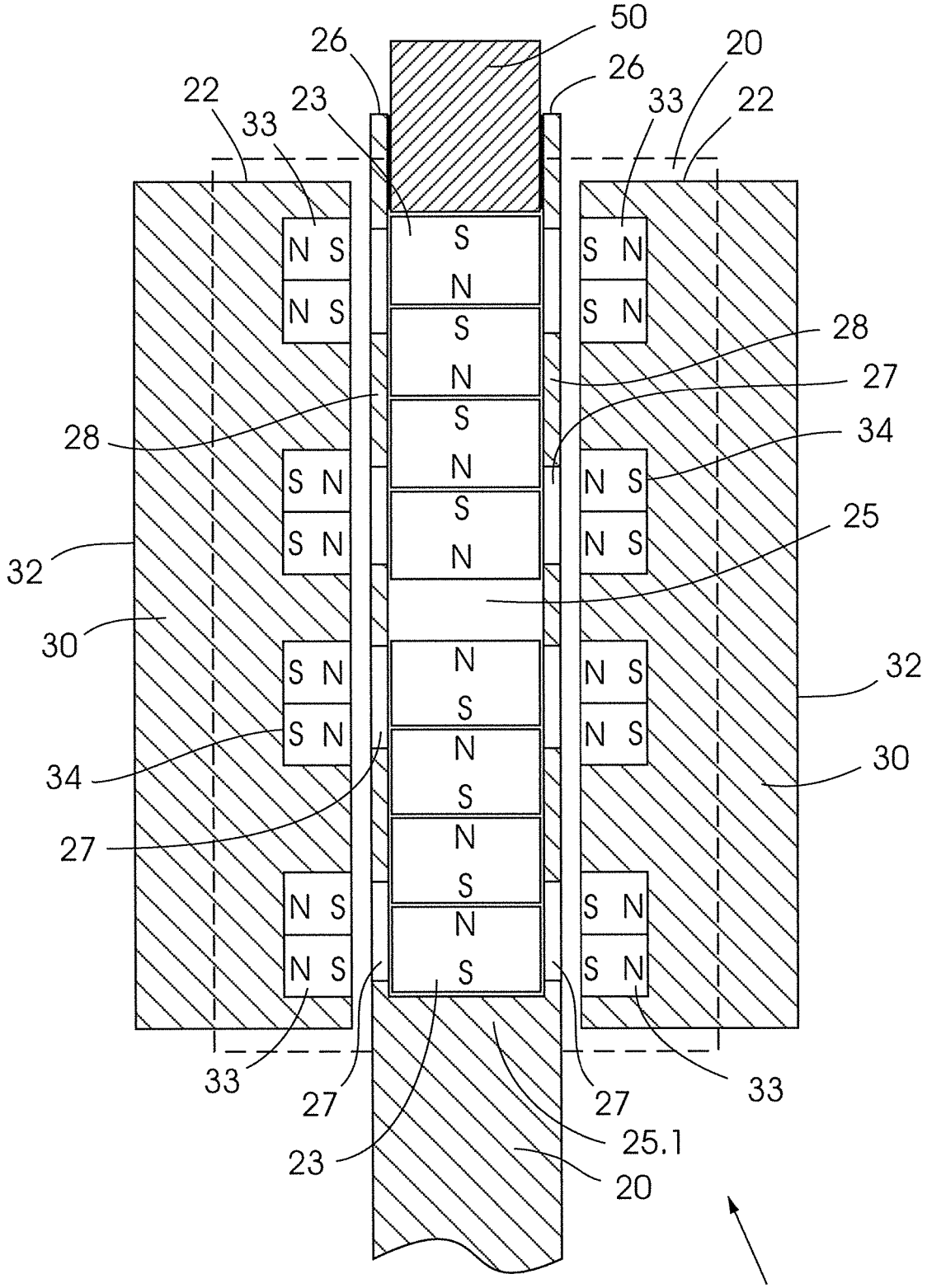
50
26
26
20
22
23
33
33
22
N S
N S
S N
S N
S N

ROTARY VANE DEVICE HAVING MAGNET ARRANGED IN ROTOR AND STATOR

CROSS-REFERENCE TO RELATED APPLICATION

This application is the 35 U.S.C. § 371 national stage application of PCT Application No. PCT/IB2016/051790, filed Mar. 30, 2016, where the PCT claims priority to and the benefit of, ZA Patent Application No. 2015/02233, filed Mar. 31, 2015, both of which are herein incorporated by reference in their entireties.

BACKGROUND TO THE INVENTION

This invention relates to a rotary vane device and more particularly but not exclusively, to a rotary vane engine or pump. The invention also relates to a rotor assembly suitable for use in such a rotary vane device.

Rotary engines and pumps are well known in the art. One common embodiment of this technology utilizes a rotor having a plurality of vanes extending radially outwardly therefrom, with the vanes being radially displaceable relative to the rotor. More particularly, the vanes on a rotary vane device travel in and out of the rotor as they move along the interior walls of the housing of the rotor. Centrifugal force or springs are used to urge the vanes towards or against the outer wall. In their extended state, these vanes adjust to the housing's (or cylinder's) profile while being driven by the rotor. The displaceable vanes, used in combination with a rotor mounted offset relative to a cylindrical housing in which it is located, result in the formation of varying volume chambers between the rotor and the housing, with the volume of a chamber changing as the rotor rotates inside the housing.

Common uses for a rotary vane pump include hydraulic fluid compression and compressed air pumps, for example in aircraft or trucks. Small rotary vane pumps can also be used for drink dispensers, medical dispensing pumps, water pumps on marine engines, compressed air drills and many other applications. The materials used to make the pump and vanes can be modified for high-temperature industrial applications such as furnace air injection or engine turbocharging. Rotary vane pumps also work well as vacuum pumps for example in aircraft applications, laboratory vacuum systems, medical applications and also to evacuate and recover refrigerants from air conditioning systems. Rotary vane engines are also known in the art.

A good seal is required between the end of a displaceable vane and the housing surface in order to maintain the efficiency of the rotary vane device. Centrifugal forces exerted on the vanes inherently contribute to ensure that a good and dynamic seal is formed between the end of a vane and an inner surface of a rotor housing. However, in some cases centrifugal forces are not sufficient, and it has accordingly been proposed to use springs to augment the outwardly directed bias of the rotating vanes. Springs, however, wear over time which adversely affects the performance and reliability of a rotary vane device incorporating spring driven vanes. In addition, it also complicates the maintenance of the device.

It has been proposed to use magnets instead of springs to provide the required bias. Although this works well, some shortcomings are associated with this solution in certain applications. For example, there is limited space to mount magnets in both the vanes of the rotor and the rotor body, and the maximum magnetic flux that can be obtained is therefore limited by the size and number of magnets that can be used due to geometrical constraints. One way of overcoming this disadvantage is presented in the applicant's co-pending application ZA2014/03295 entitled "Rotary Vane Device", the contents of which is incorporated herein by reference. In this embodiment, rotor magnets are located in the body of the rotor adjacent the vanes, and not operatively below the vane slots as is known in prior art applications.

A further disadvantage associated with existing magnet based solutions is that the vanes also have to be reasonably thick to accommodate a suitably sized magnet, and therefore take up valuable chamber volume in the process.

Existing rotors are furthermore mostly made from ferromagnetic materials, which interfere with the magnetic flux generated by the magnets, and therefore impede the efficiency of the magnetic bias.

It is accordingly an object of the invention to provide a rotary device that will, at least partially, alleviate the above disadvantages.

It is also an object of the invention to provide a rotary device which will be a useful alternative to existing rotary devices.

It is a still further object of the invention to provide a rotor for used in a rotary device that will, at least partially, alleviate the above disadvantages.

It is another object of the invention to provide a rotor for a rotary device which will be a useful alternative to existing rotors.

SUMMARY OF THE INVENTION

According to the invention there is provided a rotor, suitable for use in a rotary device, the rotor including:

- a cylindrical rotor body including a plurality of longitudinally extending receiving slots, the cylindrical rotor body further including a hollow core located radially inwardly of the receiving slots; and
- a plurality of vanes, with each vane being slidingly locatable inside a receiving slot;
- characterized in that the vanes are biased away from the cylindrical rotor by way of a magnet arrangement including vane magnets located in the vanes, and opposing rotor magnets located inside the hollow core of the rotor body.

There is provided for at least one vane magnet to be located towards an operatively inner end zone of each vane.

Preferably, the at least one vane magnet is located in an end of the vane that faces the hollow core.

There is provided for at least one rotor magnet to be located inside the hollow core of the rotor.

Preferably, a plurality of core magnets are located inside the hollow core.

There is provided for two rotor magnets with opposing polarity to be located inside the core, in order for the two magnets to be urged away from one another inside the core. The two magnets may result in a first magnetic polarity to be defined in a proximal zone of the core, and for opposing polarities to be defined in the distal ends of the core.

Preferably, there is provided for each of the two rotor magnets in the core to comprise a set of individual magnets stacked end to end to define a functionally singular magnet.

The rotor body may be in the form of a substantially solid cylindrical structure, with receiving slots and a hollow core provided in the solid cylindrical structure.

One end of the hollow core may be a blind end, whereas an opposing end of the hollow core may be an open end.

There rotor may include a plug for removably closing off the open end of the hollow core.

There is provided for the rotor body to be made from a non-magnetic material.

Preferably, the rotor body is made from a non-ferrous material.

A further feature of the invention provides for apertures to extend between the hollow core and the receiving slots.

More particularly, there is provided for the apertures to extend radially outwardly from the hollow core to the receiving slots, and more particularly to the base of the receiving slots.

At least two apertures may be provided in each receiving slot, particularly in the base of each receiving slot, with each aperture being in the vicinity of the position of a vane magnet inside the vane located in the receiving slot, in order to limit a shielding effect constituted by the body of the rotor.

BRIEF DESCRIPTION OF THE DRAWINGS

An embodiment of the invention is described by way of non-limiting example, and with reference to the accompanying drawings in which:

FIG. 4 is a schematic cross-sectional side view of another embodiment of the rotor assembly in accordance with the invention.

DETAILED DESCRIPTION OF INVENTION

Figure 1:
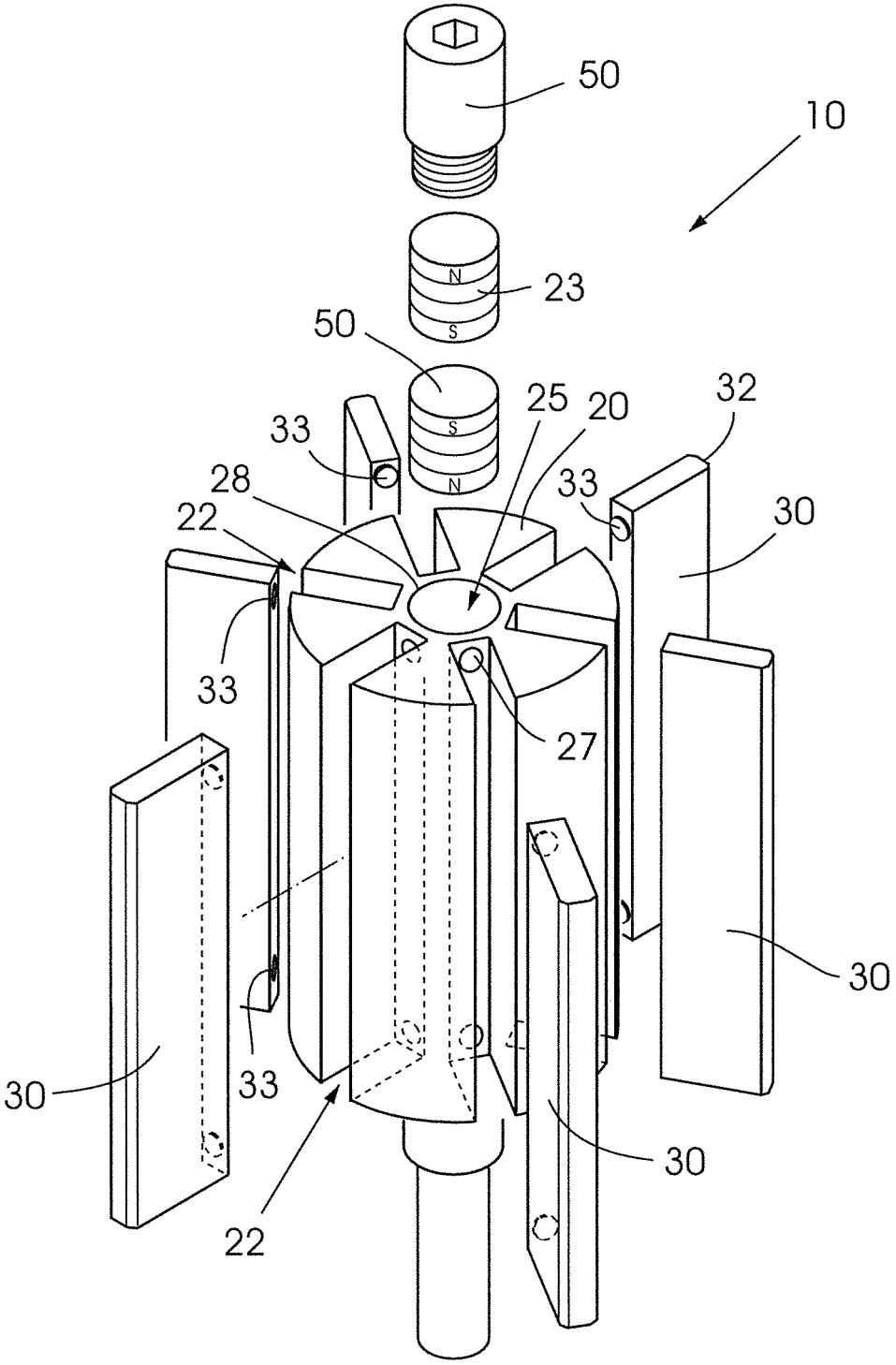
FIG. 1 is an exploded perspective view of a rotor assembly for use in a rotary device in accordance with an embodiment of the invention.
Figure 2:
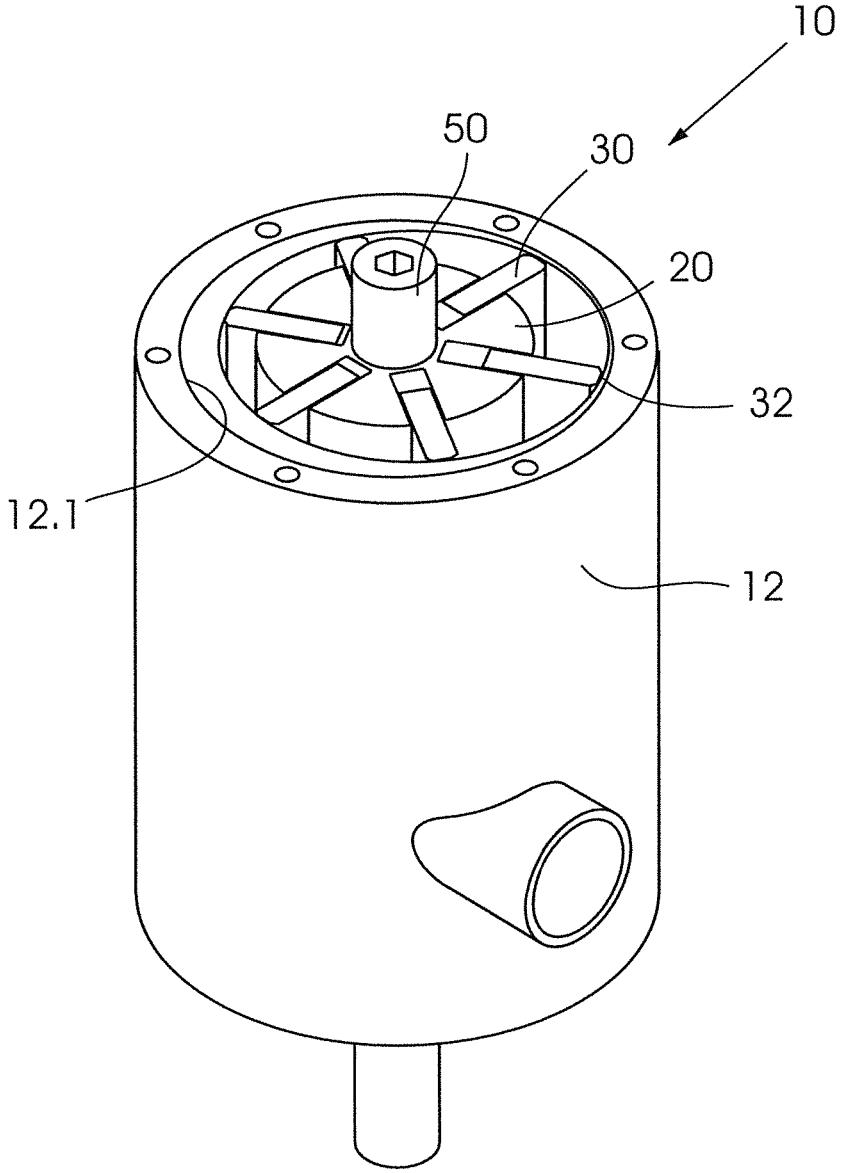
FIG. 2 is a perspective view of the assembled rotor assembly of FIG. 1 located inside a rotor housing so as to form the rotary device.
Figure 3:
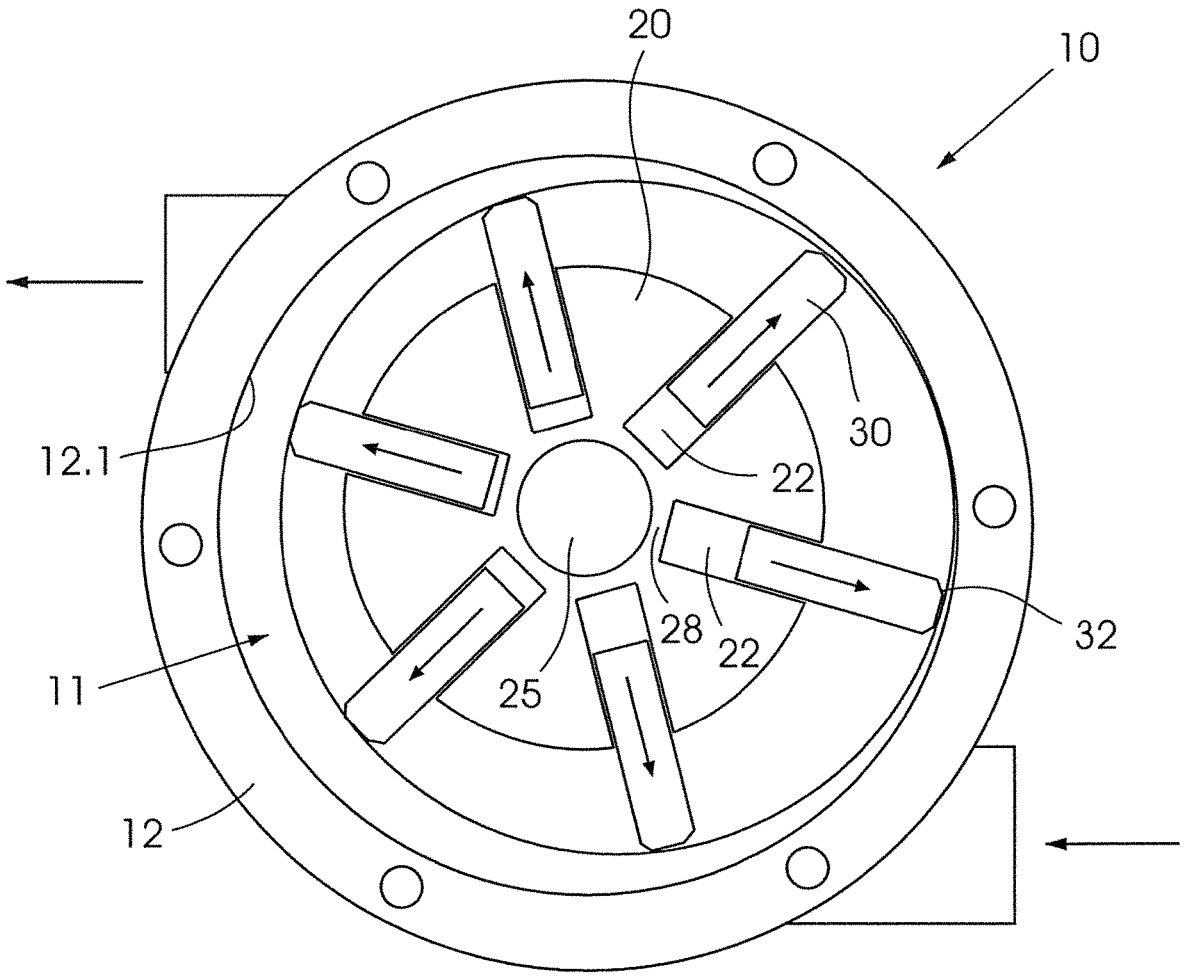
FIG. 3 is a cross-sectional end view of the rotary device of FIG. 2.

Referring to the drawings, in which like numerals indicate like features, non-limiting examples of rotary devices in accordance with the invention is generally indicated by reference numeral 10.

The rotary device 10 comprises a rotor assembly 11 that is locatable inside a complementary rotor housing 12 so as to define a part of a rotary device. The detail design of the components may vary, and are not of importance because the detail design of the rotary device will be dictated by the specific purpose for which the device will be utilized. The principles underlying this invention may, for example, find application in rotary pumps, rotary compressors and rotary engines, provided the particular rotary device does make use of radially displaceable vanes.

The rotor 11 comprises a rotor body 20 and a plurality of vanes 30 that displaceably extends from the rotor body. The rotor body 20 is of a cylindrical configuration, and is circular in cross section. The length and diameter of the body will depend on the cylinder capacity that is required for a particular application. A plurality of receiving slots 22 are provided in the body, and extends parallel to a longitudinal axis of the cylindrical body. In total, in this particular embodiment six equally spaced apart receiving slots 22 extend radially outwardly from a center of the rotor body 20, thus dividing the rotor body 20 into six sectors.

The rotor body 20 has a hollow core 25 (or bore), with one end of the hollow core 25 being a closed, blind end 25.1, and an opposite end 26 being open to the environment, but selectively closable, for example by way of a plug 50. The plug 50 and the open end 26 of the bore may for example be complementary threaded. A sealable central cavity is therefore defined in the center of the rotor body 20. It should be noted that the receiving slots 22 do not extend all the way to the hollow bore, but that bottom ends of the receiving slots 22 are separated from the hollow core by an annular wall 28. Apertures 27 are provided in this annular wall 28, which apertures extend radially outwardly from the bore 25 to the receiving slots 22. The apertures 27 are located in the proximity of the vane magnets 33 (discussed below) and serve to reduce the shielding effect of the annular wall 28, thereby improving the magnetic flux to which the vane magnets 33 are exposed. The rotor body 20 is made from a non-ferrous material in order to reduce the effect of the body 20 on the magnetic field and magnetic flux formed by the rotor magnets.

Rotor magnets 23 (meaning magnets located in the rotor) are located inside the hollow core 25 of the rotor body 20. Two magnets, or alternatively two sets of magnets of which each set functions as a single magnet, are positioned inside the core 25. The magnets are orientated so that the north-south axis of the magnets is co-axial with the longitudinal axis of the hollow core 25. The two magnets, or alternatively the two sets of magnets, are in inverted orientations in order for the same magnetic poles to face one another at a proximal zone of the hollow core 25, and for the two magnets or magnet sets therefore to repel one another. In this example, the North poles are located at a proximal zone of the core 25, whereas the South poles are located at opposing distal ends of the core 25. The net effect of this is that a combined North pole is formed in the proximal zone of the hollow core 25, whereas two South poles are formed at the distal zones of the hollow core 25. An advantage of this configuration is that the magnetic flux can be significantly higher than embodiments where the rotor magnets are located adjacent each of the receiving slots. More and larger magnets can be used, because of the reduced geometrical constraints associated with the configuration where the rotor magnets are housed in the hollow core. The aforesaid also means that the size of the vane magnets 33 can be reduced, which is described in more detail below.

Each vane 30 is in the form of a block of material 31 configured and dimensioned to fit inside a receiving slot 22. Vane magnets 33 (meaning magnets located in the vanes) are provided at the end zone of the vane that will in use be located inside the receiving slot 22, and are more particularly located in the end face of the end zone. The vane magnets 33 and the rotor magnets 23 are configured to oppose one another, in order for the vanes to be biased away from the rotor body. An opposing end 32 of the vane 30 is at least partially arcuate or tapered and in use abuts, and forms a seal against, an inner wall 12.1 of the rotor housing. The effect of this configuration is that the magnets provide a biasing force, functionally similar to that usually provided by springs, but without having the additional complexity and reliability issues associated with springs. The magnet configuration will therefore ensure that the vanes are continuously urged towards the rotor housing so as to ensure that a continuous and efficient seal is formed between the rotor and the stator.

In one example, for example the embodiment shown in FIG. 4, there is provided for a second set of vane magnets 34 to be located in a proximal zone of each vane 30. The polarity of the second set of vane magnets 34 will be inverse to the polarity of the first set of vane magnets 33, in order for the second set of vane magnets 34 to oppose the polarity at the inner ends of the rotor magnets 23. This will increase the force exerted on the vanes 30. In this embodiment apertures 27 will also be provided in the rotor body 20 in a proximal zone of the rotor annulus 28.

It will be appreciated that, even though four magnets are shown per rotor magnet set in FIG. 4, the four magnets act as a single magnet with a terminal north pole (in this case in a proximal zone of the hollow core) and a terminal south pole (in this embodiment in distal zones of the hollow core)). Any number of magnets can therefore be used (even two single, elongate magnets) provided that it defines terminal north and south poles. The fact that a polarity axis (axis extending through the poles of the magnets) of the rotor magnets is perpendicular relative to the polarity axes of the vane magnets result in the capacity to use a magnet of increased flux inside the hollow core, as this allows substantially the entire length of the core to be utilised.

In this embodiment, the rotor magnets develop a stronger magnetic flux due to:

the use of a non-ferrous rotor body;

the use of larger (i.e. stronger) and/or more rotor magnets by housing the magnets in the hollow core 25; and the provision of the apertures 27.

Due to this stronger magnetic flux, the required magnetic flux of the vane magnets 33 is reduced, and the vane magnets can therefore be smaller in size. This means that the vanes 30 can now also be of reduced thickness, which results in reduced friction, and which also enables the use of more stages or chambers—in this case six.

It will be appreciated that the above is only one embodiment of the invention and that there may be many variations without departing from the spirit and/or the scope of the invention.

The invention claimed is:

1. A rotor, suitable for use in a rotary device, the rotor including:

a cylindrical rotor body including a plurality of longitudinally extending receiving slots, the cylindrical rotor body further including a hollow core located radially inwardly of the receiving slots; and a plurality of vanes, with each of the plurality of vanes being slidingly locatable inside one of the respective receiving slots;

wherein the vanes are biased away from the cylindrical rotor by way of a magnet arrangement including vane magnets located in the vanes, and opposing rotor magnets located inside the hollow core of the rotor body; and wherein at least two rotor magnets with opposing polarity are located inside the hollow core, in order for the two magnets to be urged away from one another inside the hollow core.

2. The rotor of claim 1 in which at least one of the vane magnets is located towards an operatively inner end zone of each of the plurality of vanes.

3. The rotor of claim 1 in which each of the two rotor magnets in the hollow core comprises a set of individual magnets stacked end to end to define a functionally singular magnet.

4. The rotor of claim 1 in which the rotor body is in the form of a solid cylindrical structure, with the receiving slots and the hollow core provided in the solid cylindrical structure.

5. The rotor of claim 4 in which apertures extend between the hollow core and the receiving slots.

6. The rotor of claim 5 in which the apertures extend radially outwardly from the hollow core to the base of the receiving slots.

7. The rotor of claim 6 in which at least two apertures are provided in each of the receiving slots, with each of the apertures being in the vicinity of the position of a vane magnet inside the vane located in the receiving slot, in order to limit a shielding effect constituted by the body of the rotor.

8. The rotor of claim 1 in which the rotor body is made from a non-magnetic material.

9. A rotary vane device including a rotor of any one of claims 1 to 7.

* * * * *